US007509792B2

(12) United States Patent
Furlotti

(10) Patent No.: US 7,509,792 B2
(45) Date of Patent: Mar. 31, 2009

(54) DEVICE FOR OPENING FLEXIBLE CONTAINERS

(75) Inventor: Filippo Furlotti, Parma (IT)

(73) Assignee: Indag Gesellschaft fur Industriebedarf mbH & Co. Betriebs KG, Eppelheim (DE)

( * ) Notice: Subject to any disclaimer, the term of this patent is extended or adjusted under 35 U.S.C. 154(b) by 0 days.

(21) Appl. No.: 11/578,534

(22) PCT Filed: Apr. 14, 2004

(86) PCT No.: PCT/IT2004/000210

§ 371 (c)(1),
(2), (4) Date: Oct. 13, 2006

(87) PCT Pub. No.: WO2005/100164

PCT Pub. Date: Oct. 27, 2005

(65) Prior Publication Data

US 2007/0227103 A1 Oct. 4, 2007

(51) Int. Cl.
*B65B 43/30* (2006.01)

(52) U.S. Cl. ..... 53/571; 53/386.1

(58) Field of Classification Search ..... 53/386.1, 53/571, 573; *B65B 43/30*
See application file for complete search history.

(56) References Cited

U.S. PATENT DOCUMENTS 3,427,780 A * 2/1969 Bock ..... 53/386.1
3,430,409 A * 3/1969 Manfredonia et al. ..... 53/492
3,501,893 A * 3/1970 Peterson ..... 53/573
3,566,578 A * 3/1971 Thorne ..... 53/525
3,844,092 A * 10/1974 Stringer et al. ..... 53/571
3,982,376 A * 9/1976 Ikeda ..... 53/385.1
4,156,334 A 5/1979 Burgat
4,182,094 A * 1/1980 Lieder et al. ..... 53/386.1
4,320,615 A * 3/1982 Gmur ..... 53/67

(Continued)

FOREIGN PATENT DOCUMENTS

DE 3439473 A1 * 4/1986

(Continued)

OTHER PUBLICATIONS

International Search Report in International Patent Application No. PCT/IT2004/000210, dated Dec. 23, 2004.

*Primary Examiner*—Stephen F Gerrity
(74) *Attorney, Agent, or Firm*—Stroock & Stroock & Lavan, LLP

(57) ABSTRACT

A device for opening flexible containers, comprising a first gripping assembly (3, 4) active on a first portion of a container and second gripping assembly (5) active on a second portion of the container which faces the first portion and co-operating with the first gripping assembly (3, 4) to move the first and second portion away from each other. In operative conditions, the container is interposed between the first and second gripping assemblies (3, 4; 5). The second gripping assembly (5) is movable between at least one operative configuration in which the container is interposed between the first and second gripping assemblies (3, 4; 5) and at least one resting configuration in which the container is not interposed between the first and second gripping assemblies (3, 4; 5), as a consequence of a movement of the second gripping assemblies (5). In particular, the first and second gripping assemblies comprise suction cups (3, 4; 5).

19 Claims, 5 Drawing Sheets

U.S. PATENT DOCUMENTS 4,345,629 A * 8/1982 Inglett, Jr. ..... 53/573
4,577,454 A * 3/1986 Wright et al. ..... 53/386.1
4,726,170 A * 2/1988 Sawa et al. ..... 53/386.1
4,840,016 A * 6/1989 Muller, Jr. ..... 53/459
5,119,615 A * 6/1992 Kujubu et al. ..... 53/573
5,201,166 A * 4/1993 Johnsen ..... 53/386.1
5,507,132 A * 4/1996 Gwiazdon et al. ..... 53/386.1
5,970,688 A * 10/1999 Nyiendo et al. ..... 53/573
6,003,289 A * 12/1999 McGregor et al. ..... 53/570

FOREIGN PATENT DOCUMENTS

JP 05 305915 A 11/1993
JP 10-129621 A * 5/1998
WO WO 99/59876 A 11/1999

* cited by examiner

DEVICE FOR OPENING FLEXIBLE CONTAINERS

TECHNICAL FIELD AND BACKGROUND ART

The present invention relates to a device for opening flexible containers.

It is well known that drinks for human consumption, in particular fruit juices and dietary complements, are ever more frequently sold and preserved inside flexible containers, commonly called "pouches".

Specifically, such containers comprise a flexible pouch, generally made of polyethylene, and a spout, able to allow the outflow of the product preserved within the container.

The outflow of the product is made particularly convenient by the possibility of exerting an adequate pressure on the drink, squeezing the pouch.

Flexible containers, or pouches, are obtained from a pair of polyethylene sheets peripherally sealed to each other and having an inlet adapted to allow the filling of the container with the desired drink.

In correspondence with the aforesaid inlet is inserted and secured, by sealing, a portion of the spout. In particular, said sealing operation involves the edges of said inlet and is performed by heating means which cause a partial melting of the edges themselves, causing them to adhere to the portion of the spout inserted into the pouch.

The insertion of the spout into said inlet takes place before the container is filled.

A particularly acute problem in the pouch filling sector concerns the opening of the pouches, to allow the insertion of the spout.

The opening of the flexible containers is particularly difficult because the polyethylene sheets tend to adhere to each other, by effect of their reduced thickness and of electrostatic attraction.

This problem has been confronted and partially solved by the apparatus disclosed in the document U.S. Pat. No. 4,182,094, in which a plurality of suction cups are used to open a flexible container.

Specifically, three suction cups are located on a movable head, whilst a pair of suction cups is positioned and buried within a support plane.

The flexible container is interposed between the suction cups installed on the movable head and the suction cups buried within the support plane.

The suction cups present on the movable head are set side by side and mutually aligned, so that two lateral suction cups and a central suction cups can be identified. In particular, the central suction cup is of the bellows type and its grip plane can thus move rearwards relative to the grip plane defined by the remaining pair of suction cups, allowing a flexion of the container which favours the entry of air into the container, thereby facilitating its opening.

The apparatus summarily described above has the important drawback that it does not operate continuously, but it is an apparatus in which the containers to be treated are fed at successive time intervals. Moreover, the arrangement of the suction cups shown in said apparatus is absolutely not adaptable to an apparatus with continuous feeding of the containers, especially to an apparatus in which the containers to be treated are positioned on a rotary carrousel.

Secondly, the flexion of the pouches during the opening phase is strongly conditioned by the efficiency of the bellows suction cup. If said suction cup does not effectively adhere to the pouch, the latter is not able to flex to such an extent as to allow the entry of a sufficient quantity of air to allow its opening.

DISCLOSURE OF THE INVENTION

An object of the present invention is to provide a device for opening flexible pouches which can be installed on a rotary carrousel with continuous feeding of flexible pouches.

Another object of the present invention is to propose a device for opening flexible containers, which is able to assure the opening of the pouches themselves.

A further object of the present invention is to propose a device for opening flexible containers, which is simple to build and reliable.

Said objects are fully achieved by the device for opening flexible containers of the present invention, which are characterised by the content of the appended claims.

BEST MODE FOR CARRYING OUT THE INVENTION

These and other features shall become more readily apparent from the following description of a preferred embodiment illustrated, purely by way of non limiting example, in the accompanying drawing tables, in which.

With reference to the figures, the device for opening flexible containers in accordance with the invention is globally designated by the reference number 1.

The device 1 is installed on a rotary carrousel (not shown) by means of a support structure 2.

The device 1 comprises a pair of suction cups 3, 4 fastened to the support structure 2 and active on a first external lateral face of a flexible container, preferably in correspondence with an inlet thereof. In the illustrated example, said pair of suction cups 3, 4 defines first grip means of the device 1.

Figure 5:
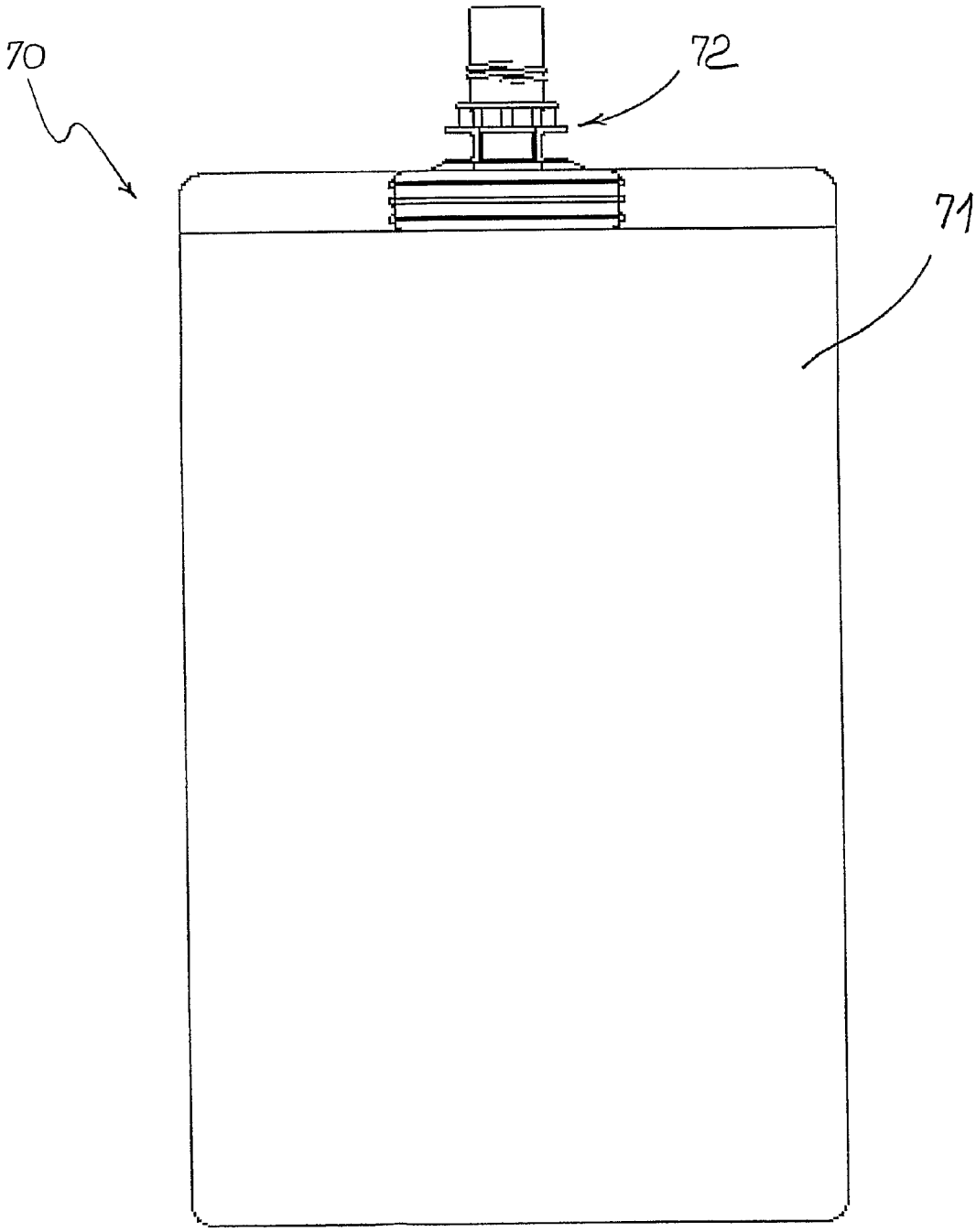
FIG. 5 shows a front view of a flexible container.

With particular reference to FIG. 5, the flexible container is globally designated by the number 70 and comprises external lateral faxes 71 (only one of which is visible) and a spout 72.

The device 1 comprises a third suction cup 5 active on a second external lateral face of a flexible container, preferably in correspondence with the inlet thereof. In particular, said second lateral face is substantially opposite to said first lateral face of the container.

In the illustrated example, the third suction cup 5 defines second grip means of the device 1 and, in operative configuration (FIGS. 1 and 2), it substantially faces the pair of suction cups 3, 4.

Figure 1:
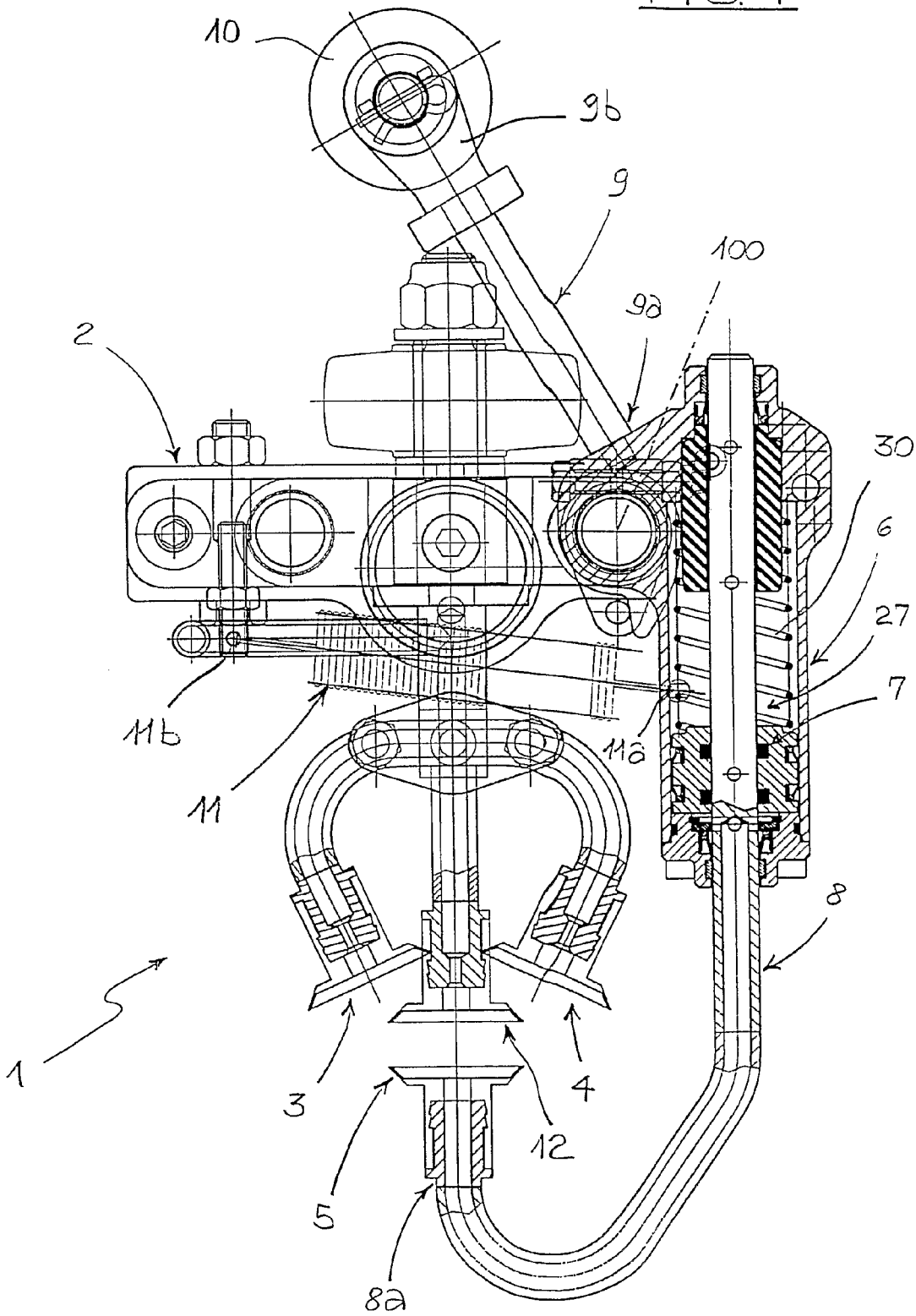
FIG. 1 shows a partially sectioned plan view of a device for opening flexible containers in accordance with the invention, in a first operative configuration.
Figure 2:
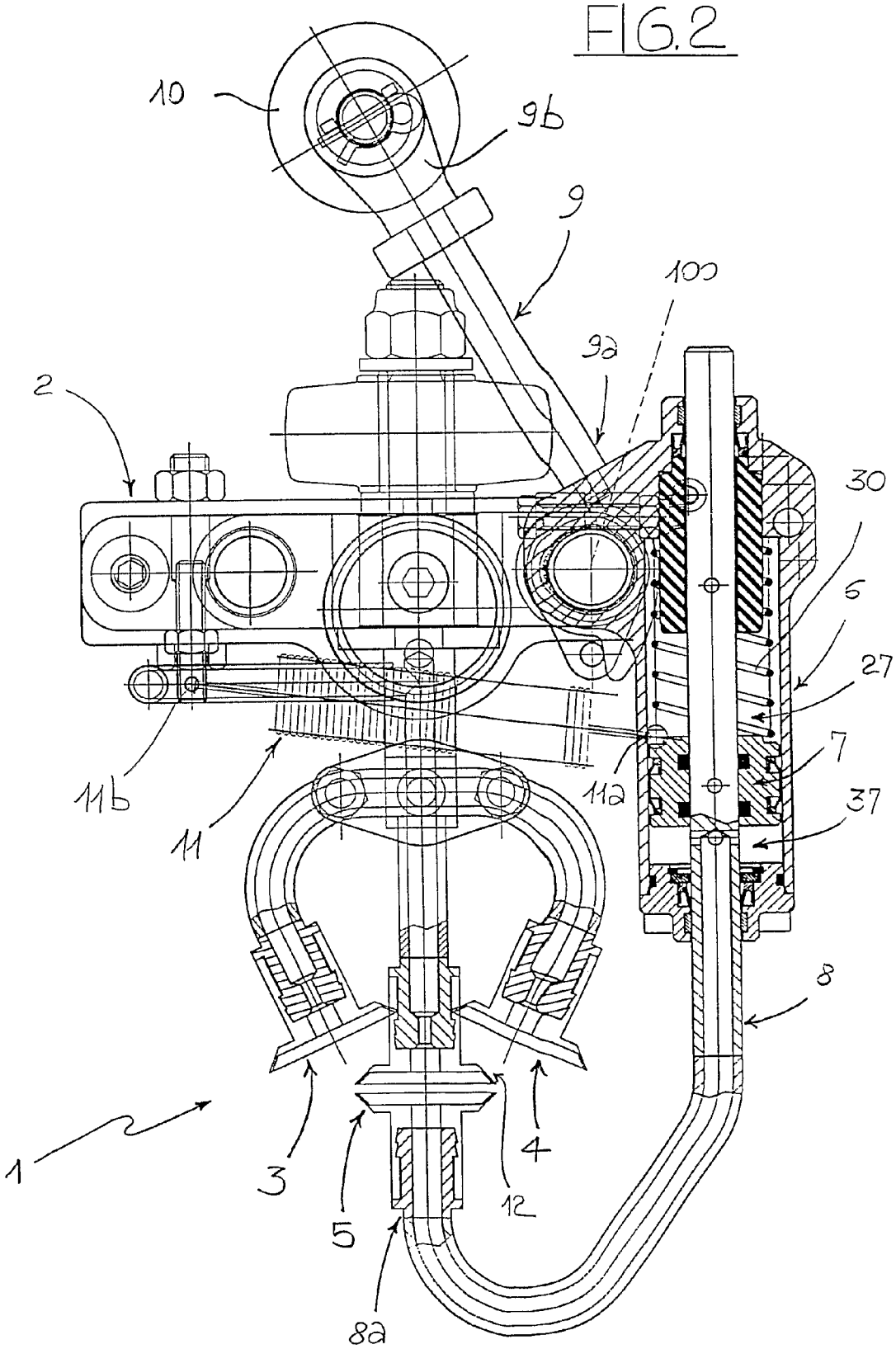
FIG. 2 shows a partially sectioned plan view of the device shown in FIG. 1, in a second operative configuration.

With particular reference to FIGS. 1 and 2, when the device 1 is in operative configuration, the container is interposed between the pair of suction cups 3, 4 and the third suction cup 5.

The suction cups 3, 4 co-operate with the third suction cup 5, to move the lateral faces of the container away from each other, allowing their opening.

In absolutely new and original fashion, the second grip means, defined by the third suction cups 5, are movable between an operative configuration in which the container is interposed between said first and said second grip means and a resting configuration in which the container is not interposed between said first and said second grip means. Specifically, the second grip means are pivotally connected to the support structure 2, in order to be able to rotate between said operative configuration and said resting configuration.

In the illustrated example, the device 1 comprises a guide 6 hinged to the support structure 2 and a cursor 7, slidably movable within the guide itself. In particular, the cursor 7 divides the guide 6 into a first and a second chamber 27, 37, each of which has a volume that is variable according to the position assumed by the cursor 7 within the guide itself.

To the cursor 7 is integrally connected a rod-like element 8, at one end 8*a* whereof is fastened the third suction cup 5.

In the chamber 27 of the guide 6 is housed a spring 30, operatively active on the cursor 7 to maintain it in an initial resting position.

The device 1 also comprises means to rotate the guide 6 about a hinge axis 100.

With reference to the figures, the means for rotating the guide 6 comprise a rod 9 having a first end 9*a* integrally connected to the guide 6 and a second end 9*b*, whereon is mounted a roller 10 which slides on a fixed cam, not illustrated herein. Said means further comprise a spring 11 having a first end 11*a* connected to the guide 6 and a second end 11*b* connected to said support structure.

The device 1 comprises means for creating a pre-set degree of vacuum in said chambers 27, 37 defined within the guide 6, to actuate a sliding motion of the cursor 7 within the guide itself. In the preferred embodiment, said means for creating vacuum comprise at least a pump 40.

The operation of the invention is as follows.

A rotary carrousel whereon is installed a pre-set number of opening devices in accordance with the invention bears each of said devices in correspondence with a station for feeding the flexible containers.

Figure 3:
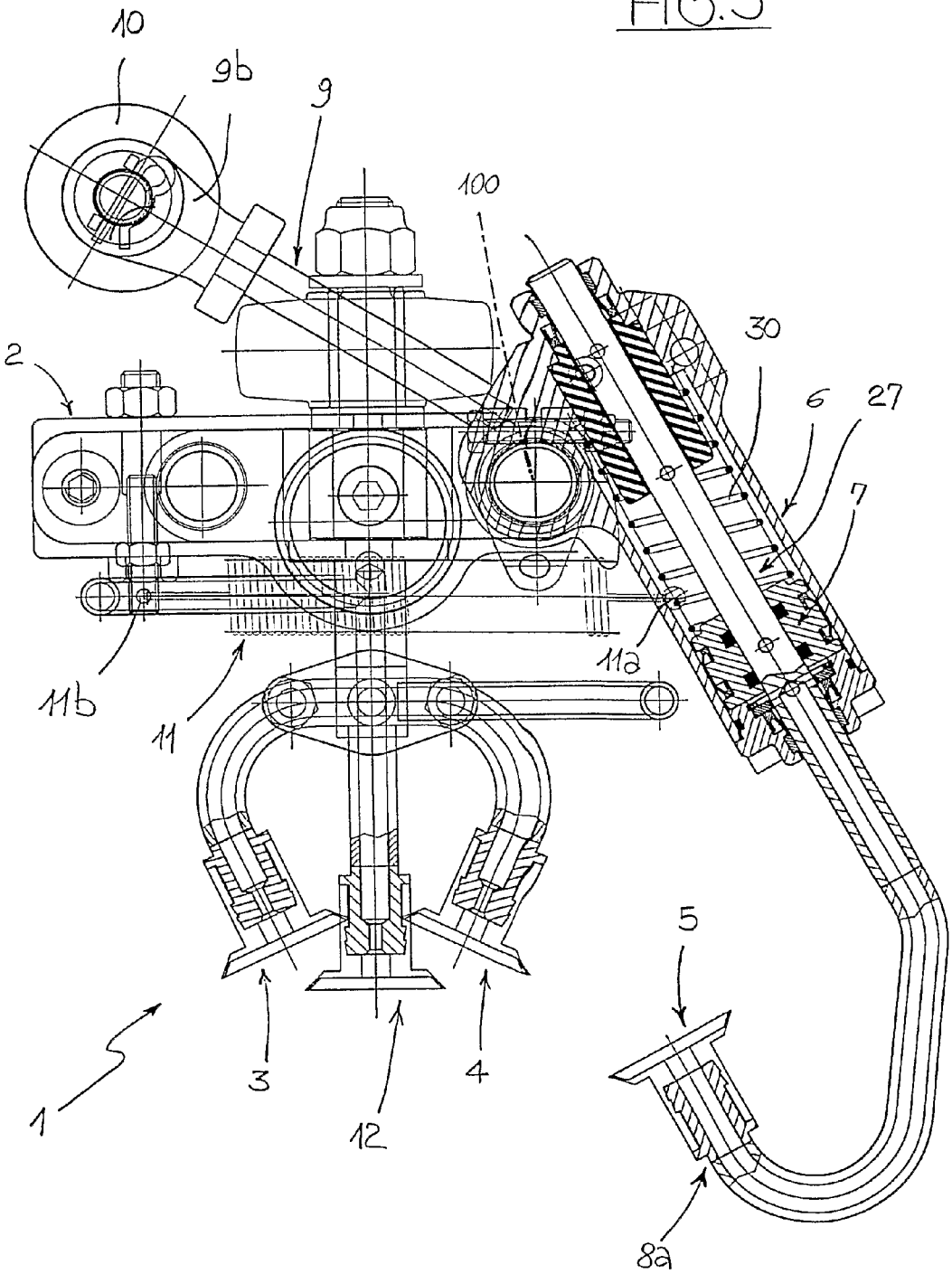
FIG. 3 shows a partially sectioned plan view of the device shown in FIG. 1, in a resting configuration.

The device 1 is readied to receive the container by moving the third suction cup 5, from the operative configuration shown in FIGS. 1 and 2 to the resting configuration shown in FIG. 3.

The movement of the third suction cup 5 takes place by the rotation of the guide 6 about the hinge axis 100, by means of the rod 9 actuated by the roller 10.

The latter, during the rotation of the carrousel, comes in contact with a cam (not shown), appropriately shaped and fixed, to synchronise the movement of the third suction cup 5 with the rotation of the carrousel.

The flexible container is received and held by aspiration by a fourth gripping suction cup 12, whilst the third suction cup 5 is repositioned in front of the pair of suction cups 3, 4, by effect of the advancement of the carrousel and of the interaction between the roller 10 and the fixed cam.

In the illustrated example, the gripping plane of the suction cups 3, 4 is advantageously inclined relative to the gripping plane of the suction cup 12.

Subsequently, the means for creating a vacuum start aspirating air within an open pneumatic circuit (FIG. 4), which branches off in such a way as to reach the using devices, i.e. the pair of suction cups 3, 4, the third suction cup 5, the fourth gripping suction cup 12 and the chambers 27, 37 present inside the guide 6.

In particular, aspirating air from the chamber 27 of the guide 6, the force of the spring 30 is overcome and the cursor 7 can thus move within the guide, dragging the rod-like element 8 with it, thus approaching the third suction cup 5 to the second external lateral wall of the container. Since the aspiration also involves the third suction cup 5, the latter adheres to said second external lateral face of the container.

The third suction cup 5, after adhering to the second external lateral face of the container, thrusts the container against the suction cups 3, 4.

The container is thereby forced to flex and to assume a curvature proportioned to the inclination of the grip plane of the suction cups 3, 4, which adhere to the first external lateral face by effect of the aspiration performed within said pneumatic circuit. Continuing the aspiration, a pre-set degree of vacuum is created within the second chamber 37 of the guide 6 as well. In this way, the air pressure in the two chambers is equalised and the spring 30 is allowed to return the third suction cup 5 to the initial position, thereby opening the container.

The pneumatic circuit is dimensioned in such a way that there are preferential aspiration paths.

In particular, this result is obtained by means of appropriate calibrated holes obtained in correspondence with each user device.

Figure 4:
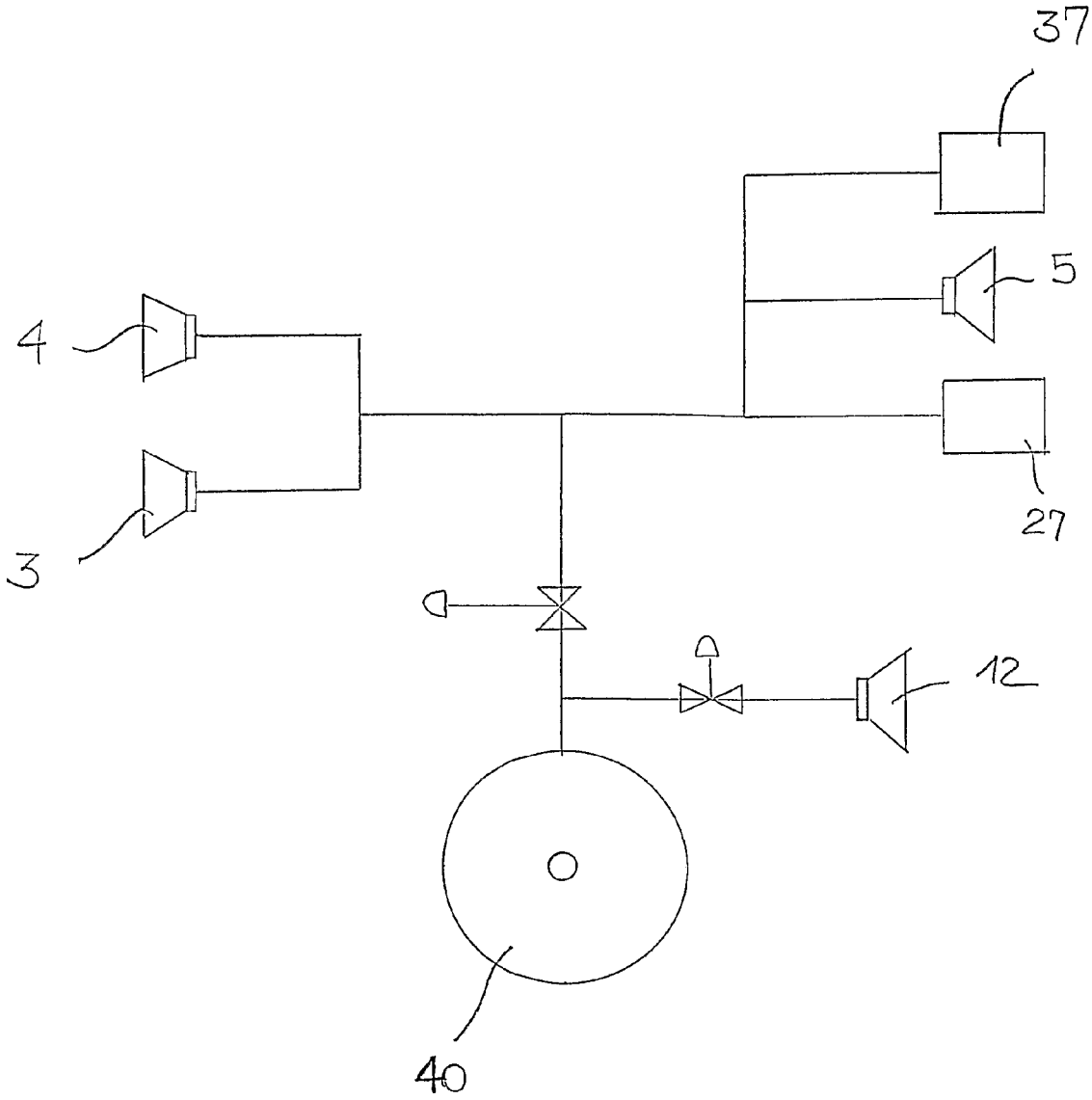
FIG. 4 shows a diagram of the operation of the device shown in FIGS. 1, 2 and 3.

With particular reference to FIG. 4, the effects of the aspiration of the pump 40 will manifest themselves, in cascade fashion, in the first chamber 27 of the guide 6, on the third suction cup 5 and in the second chamber 37 of the guide 6.

In this way, if the third suction cup 5 is detached from the outer face of the container during the separation from the suction cups 3, 4, air would be aspirated through the suction cup 5 itself and not by the second chamber 37. Since aspiration in the first chamber 27 of the guide 6 is not interrupted, this allows to re-approach the third suction cup 5 to the auction cups 3, 4 and automatically to retry opening the container.

The invention achieves important advantages.

First of all, an opening device according to the invention can be installed on a rotary carrousel with continuous feeding of the pouches. The possibility of moving the third suction cup 5 away from the pair of suction cups 3, 4 enables the device 1 to receive the pouches directly from a feeding station, to open them and transfer them to a subsequent treatment or collection station.

Secondly, an opening device according to the invention is able to guarantee the opening of the containers, since the conformation of the pneumatic circuit allows automatically to re-attempt the opening operation, if the third suction cup 5 becomes detached from the second outer lateral face of the container.

Another advantage is given by the inclination of the suction cups 3, 4, which force the container to flex, assuming a curvature that is proportioned to the inclination of the grip plane of the suction cups. This considerably facilitates the opening of the container, since it favours the entry of air into the container, making it easier to separate the sheets which constitute it.

Advantageously, such a device for opening flexible containers is extremely reliable.

The invention claimed is:

1. A system for opening a flexible container, the system comprising:

a first gripping assembly constructed and arranged to grip a flexible container at a first side;

a second gripping assembly constructed and arranged to grip the flexible container at a second side;

the second gripping assembly comprising a housing having a selectively displaceable sliding member therewithin adapted to move the second gripping assembly relative to the first grippping assembly;

the housing and the sliding member being constructed and arranged to define a first chamber and a second chamber, wherein the sliding member divides the first chamber from the second chamber; wherein the housing is constructed and arranged to house a spring therein, the spring constructed and arranged to apply a biasing force on the sliding member;

a vacuum source constructed and arranged to remove air from the first chamber or the second chamber until a predetermined vacuum is achieved, whereby the sliding member is adapted to be displaced within the housing by the removing of air from the first or second chamber; and the first gripping assembly and the second gripping assembly cooperating to bend the flexible container and subsequently pull the first side away from the second side to open the flexible container.

2. The system of claim 1, wherein the second gripping assembly comprises one second suction cup constructed and arranged to apply a suction force on the second side.

3. The system of claim 2, wherein the first gripping assembly comprises one or more first suction cups constructed and arranged to apply a suction force on the first side, wherein the first suction cups at least substantially face the second suction cup.

4. The system of claim 2, further comprising an aspirating mechanism connected to the second suction cup.

5. The system of claim 1, wherein the first gripping assembly comprises one or more first suction cups constructed and arranged to apply a suction force on the first side.

6. The system of claim 5, further comprising an aspirating mechanism connected to the one or more first suction cups.

7. The system of claim 1, further comprising a support, wherein the first gripping assembly and second gripping assembly are mounted on the support.

8. The system of claim 7, wherein the support includes a pivot, the second gripping assembly being selectively pivotable about the pivot toward and away from the first gripping assembly.

9. The system of claim 1, further comprising a cam surface, wherein the second gripping assembly comprises a roller constructed and arranged to be selectively slidable along the cam surface to move the second gripping assembly toward or away from the first gripping assembly.

10. The system of claim 1, wherein the first gripping assembly includes a retaining suction cup constructed and arranged to retain the flexible container in place with respect to the first gripping assembly.

11. The system of claim 10, further comprising an aspirating mechanism connected to the retaining suction cup.

12. The system of claim 1, wherein: the second gripping assembly includes one second suction cup constructed and arranged to apply a suction force on the second side of the flexible container; and the second suction cup is connected to the sliding member such that moving the sliding member moves the second suction cup.

13. The system of claim 12, wherein the sliding member is moved by creating a vacuum in the first chamber.

14. The system of claim 12, wherein the sliding member is moved by creating a vacuum in the second chamber.

15. The system of claim 1, wherein the housing is selectively rotatable.

16. The system of claim 1, further comprising:

a support;

a cam surface; and a rotating assembly constructed and arranged to selectively rotate the housing, the rotating assembly comprising:

a rod connected to the housing at a first end and a roller at a second end, and a spring connected to the housing at a first end and the support at the second end, wherein the roller is constructed and arranged to selectively slide along the cam surface to rotate the housing.

17. The system of claim 1, further being constructed and arranged to automatically reattempt to open the flexible container if the second gripping assembly becomes detached from the flexible container.

18. The system of claim 1, wherein the system is constructed and arranged to receive a continuous feed of the flexible containers.

19. The system of claim 1, wherein the second gripping assembly is constructed and arranged to transport the flexible container from a first station at which the flexible container is introduced into the system, to a second station at which the flexible container is released from the system.

* * * * *